US006176275B1

(12) United States Patent
Hill

(10) Patent No.: US 6,176,275 B1
(45) Date of Patent: Jan. 23, 2001

(54) VAPOR RECOVERY SYSTEM FOR MOBILE FUELERS

(76) Inventor: Bob J. Hill, 1028 N. Manor, Tulare, CA (US) 93274

( * ) Notice: Under 35 U.S.C. 154(b), the term of this patent shall be extended for 0 days.

(21) Appl. No.: 09/243,747

(22) Filed: Feb. 3, 1999

(51) Int. Cl.[7] ..... B65B 31/04

(52) U.S. Cl. ..... 141/65; 141/59; 141/98; 141/231; 141/285

(58) Field of Search ..... 141/59, 83, 65, 141/98, 231, 285, 290, 44, 45; 280/832, 837, 838, 839

(56) References Cited

U.S. PATENT DOCUMENTS

| | | | | |
|---|---|---|---|---|
| 2,331,879 | * | 10/1943 | White | 280/832 |
| 3,687,087 | * | 8/1972 | Yurkoski et al. | 280/5 |
| 3,814,148 | * | 6/1974 | Wostl | 141/98 |
| 3,941,168 | * | 3/1976 | Hiller et al. | 141/59 |
| 3,981,334 | * | 9/1976 | Deters | 141/59 |
| 3,981,335 | * | 9/1976 | Deters | 141/59 |
| 5,035,729 | * | 7/1991 | Hodgkins | 141/44 |
| 5,103,877 | * | 4/1992 | Sherwood et al. | 141/59 |
| 5,174,346 | | 12/1992 | Healy . | |
| 5,178,197 | | 1/1993 | Healy . | |
| 5,207,249 | | 5/1993 | Healy . | |
| 5,297,574 | | 3/1994 | Healy . | |
| 5,305,807 | | 4/1994 | Healy . | |
| 5,327,944 | | 7/1994 | Healy . | |
| 5,386,859 | | 2/1995 | Healy . | |
| 5,494,409 | * | 2/1996 | Webb et al. | 141/285 |
| 5,513,680 | * | 5/1996 | Hilliard, Jr. et al. | 141/231 |
| 5,584,279 | | 12/1996 | Brunnhofer . | |
| 5,676,181 | | 10/1997 | Healy . | |
| 5,765,603 | | 6/1998 | Healy . | |
| 5,983,962 | * | 11/1999 | Gerardot | 141/231 |

OTHER PUBLICATIONS

State of California Executive Order G–70–166, "Certification of the Sacramento Municipal Utility District Mobile Motor Vehicle Fueler Phase II Vacuum Assist Vapor Recovery System", 7 pp.

* cited by examiner

*Primary Examiner*—Henry J. Recla
*Assistant Examiner*—Khoa Huynh
(74) *Attorney, Agent, or Firm*—Lyon & Lyon LLP

(57) ABSTRACT

A system for recovering fuel vapor during delivery of fuel by a mobile fueler includes a storage tank covered with a layer of insulation, a supply pump connected to the storage tank for delivering fuel therefrom, and a fuel dispensing assembly, preferably a coaxial hose and nozzle, including a supply outlet for delivering fuel to a vehicle being fueled, and a vapor recovery inlet proximate the supply outlet. A diverter valve diverts a portion of the fuel in the supply line, and a vacuum jet pump is connected to the storage tank and, by a vapor line, to the vapor recovery inlet, which is driven by the diverted fuel to create a vacuum in the vapor line to draw vapor into the vapor recovery inlet, through the vapor line, and into the storage tank. A vapor pot is provided in the vapor line for separating liquid fuel from vapor in the vapor line and for returning separated liquid fuel back into the supply line. Fuel pressures between 20 and 40 psi drive the vacuum jet pump to create a vacuum between −20 and −80 inches w.g. in the vapor line and thereby recover fuel vapor from the supply outlet of the fuel dispensing assembly at efficiencies of at least 95 percent.

32 Claims, 2 Drawing Sheets

VAPOR RECOVERY SYSTEM FOR MOBILE FUELERS

FIELD OF THE INVENTION

The present invention relates generally to systems for delivering volatile liquids, such as gasoline or other fuels, to vehicles, and more particularly to vapor recovery systems for fuel trucks or other mobile fuelers that recover vapors from fuel dispensers during fuel delivery.

BACKGROUND

Volatile liquids, such as gasoline or other fuels, are generally delivered to the fuel tank of an automobile or other vehicle using a fuel dispensing nozzle. During delivery, gasoline vapors may evaporate from liquid gasoline due to heat and/or agitation of the gasoline. If these vapors are not recovered, they may escape from the nozzle, contributing to air pollution and/or wasting fuel resources. Thus, recovery of vapors resulting from the delivery of gasoline may be desirable and, in addition, may be mandated by regulatory agencies. For example, in the 1970's, the State of California enacted legislation requiring recovery of at least 94.5 percent of all vapors resulting from fuel delivery.

To recover gasoline vapors during delivery, fuel dispensing nozzles having a coaxial construction are often used. The nozzle generally has an inner spout connected to a supply line which provides a supply outlet for the gasoline being supplied to the fuel tank being filled. A vapor conduit, such as a boot assembly, surrounds the inner spout which has a vapor inlet proximate the supply outlet. The nozzle is connected to a coaxial hose, which is connected to a valve which separates the supply line from the vapor line.

Generally, the nozzles and hoses are connected to stationary pumps, such as at service stations, which are connected to storage tanks, often located underground, that store large volumes of fuel. Vapor recovery systems for such stationary fuels sources have been proposed and implemented which recover a substantial amount of the vapors from fuel dispensing nozzles. For example, U.S. Pat. No. 4,068,687 issued to Long discloses a system which includes a hydraulic motor and a pneumatic pump synchronized with one another and connected to the supply and vapor lines, respectively. The gasoline flowing from the supply pump drives the hydraulic motor, and the pneumatic pump then withdraws vapors from the fuel tank being filled, which may then be directed back to the storage tank. Similarly, U.S. Pat. No. 5,207,249 issued to Healy discloses a liquid jet gas pump that may be mounted in the main supply line to create a vacuum in a vapor line.

For mobile fuelers, such as fleet fueling trucks, however, conventional vapor recovery systems have been unable to efficiently recover gasoline vapors during delivery. Vapor pressures encountered in the storage tanks of mobile delivery systems may be substantially higher than those found in underground stationary tanks, for example, due to increased heat experienced by mobile fuel truck storage tanks and/or increased agitation of the gasoline resulting from movement of the fuel truck. Despite regulations in California and elsewhere since the 1970's, an efficient vapor recovery system for mobile fuelers has not been successfully developed.

Accordingly, there is a need for a more efficient vapor recovery system for mobile fuelers.

SUMMARY OF THE INVENTION

The present invention is directed to a fuel delivery and vapor recovery system for a mobile fueler, and to methods of recovering fuel vapor from mobile fueling systems. In accordance with one aspect of the present invention, a system is provided that includes a mobile storage tank having a liquid region and a vapor region therein. The storage tank is at least partially covered with a layer of insulation, such as polyurethane foam, providing a predetermined thermal insulating value, preferably at least about R-14.

A supply pump is connected to the storage tank for delivering fuel from the liquid region, and a fuel dispensing assembly is connected in line with the supply pump. The fuel dispensing assembly preferably includes a supply outlet for delivering fuel from the storage tank to a vehicle being fueled, and a vapor recovery inlet proximate the supply outlet. A diverter valve is provided for diverting a portion of the fuel in the supply line, and one or more vacuum jet pumps are connected by a vapor line to the vapor recovery inlet and also to the diverter valve. The vacuum jet pump is driven by the fuel diverted from the supply line to create a predetermined vacuum pressure in the vapor line, the vacuum jet pump being connected to the storage tank to direct vapor from the vapor recovery inlet through the vapor line into the vapor region of the storage tank.

In a preferred form, the system also includes a vapor pot in the vapor line for separating liquid fuel from vapor in the vapor line, the vapor pot being preferably mounted at a low point of the system. The vapor pot may be connected to the supply line for returning separated liquid fuel back to the supply line, for example, by a siphon check valve connected between the vapor pot and the supply line.

In another aspect of the present invention, a kit is provided for retrofitting a mobile fueler having an existing storage tank and supply line, preferably including a supply pump, for delivering fuel from the storage tank to a vehicle being fueled. The kit may include a diverter valve, a fuel dispensing assembly including a supply outlet for delivering fuel to the vehicle being fueled, and a vapor recovery inlet proximate the supply outlet, a vapor pot and a vacuum jet pump.

The diverter valve may be connectable in the supply line for diverting a portion of the fuel being delivered from the storage tank, and the fuel dispensing assembly may be connectable to the supply line. The vapor pot may be connectable by a vapor line to the vapor recovery inlet for separating liquid fuel from vapor in the vapor line. The vacuum jet pump has a vapor inlet connectable to the vapor line, a vapor outlet connectable to the storage tank, and a fuel inlet connectable by a fuel diversion line to the diverter valve. The vacuum jet pump has a fuel path through which fuel diverted from the supply pump may be directed to create a predetermined vacuum pressure in the vapor inlet and consequently in the vapor line.

In a preferred form, the fuel dispensing assembly includes a coaxial hose and nozzle, a vapor adapter splitter valve, and may include a hose reel for storing the coaxial hose or other hose retractor assembly. The kit also preferably includes foam insulation for covering at least a portion of the storage tank, the foam insulation having a thermal insulating value preferably of at least about R-14.

Preferably, the vacuum jet pump is configured to generate a vacuum between about −20 inches and about −80 inches of water column at the vapor inlet when driven by a fuel pressure between about 20 psi and about 40 psi. More preferably, the vacuum jet pump generates a vacuum pressure in the vapor line between about −20 inches and about −40 inches water column when fuel is being delivered through the fuel dispensing assembly, and between about −40 inches and about −72 inches of water column when fuel is not being delivered. Thus, the kit, when incorporated into a fuel delivery system, may provide a vapor recovery system capable of recovering at least about 95% of the fuel vapor emitted by the fuel dispensing assembly.

In accordance with still another aspect of the present invention, a method is provided for recovering fuel vapor during delivery of fuel from a mobile fuel delivery system to a vehicle. The method may include the steps of providing a mobile storage tank and a supply line communicating with the storage tank, and providing a fuel dispensing assembly connected to the supply line, the fuel dispensing assembly comprising a supply outlet and a vapor recovery inlet proximate the supply outlet. Fuel may be directed from the storage tank through the supply line to the supply outlet, and a portion of the fuel in the supply line may be diverted to generate a predetermined vacuum pressure at the vapor recovery inlet to substantially recover fuel vapor emitted from the supply outlet. The recovered fuel vapor may then be directed into the storage tank.

Preferably, the vacuum is generated by directing the diverted fuel through a vacuum jet pump to create the predetermined vacuum pressure in a vapor line communicating with the vapor recovery inlet. Vapor from the storage tank may be controllably introduced into the vapor line to maintain the predetermined vacuum pressure, for example, to maintain the predetermined vacuum pressure within a range between about −20 inches and about −80 inches of water column.

An important feature of the systems and methods of the present invention is that the pressures of the system, e.g., the vacuum pressure in the vapor line, the vapor pressure in the storage tank, and the fuel pressure in the supply line, may be effectively controlled to facilitate efficient recovery of fuel vapor from fuel dispensing assemblies, such as coaxial hoses and nozzles. Thus, a vapor recovery system in accordance with the present invention may enable recovery of at least about 95 percent of the fuel vapors emitted during fuel delivery, and more preferably at least about 98 percent.

Other objects and features of the present invention will become apparent from consideration of the following description taken in conjunction with the accompanying drawings.

DETAILED DESCRIPTION OF THE PREFERRED EMBODIMENTS

Figure 1:
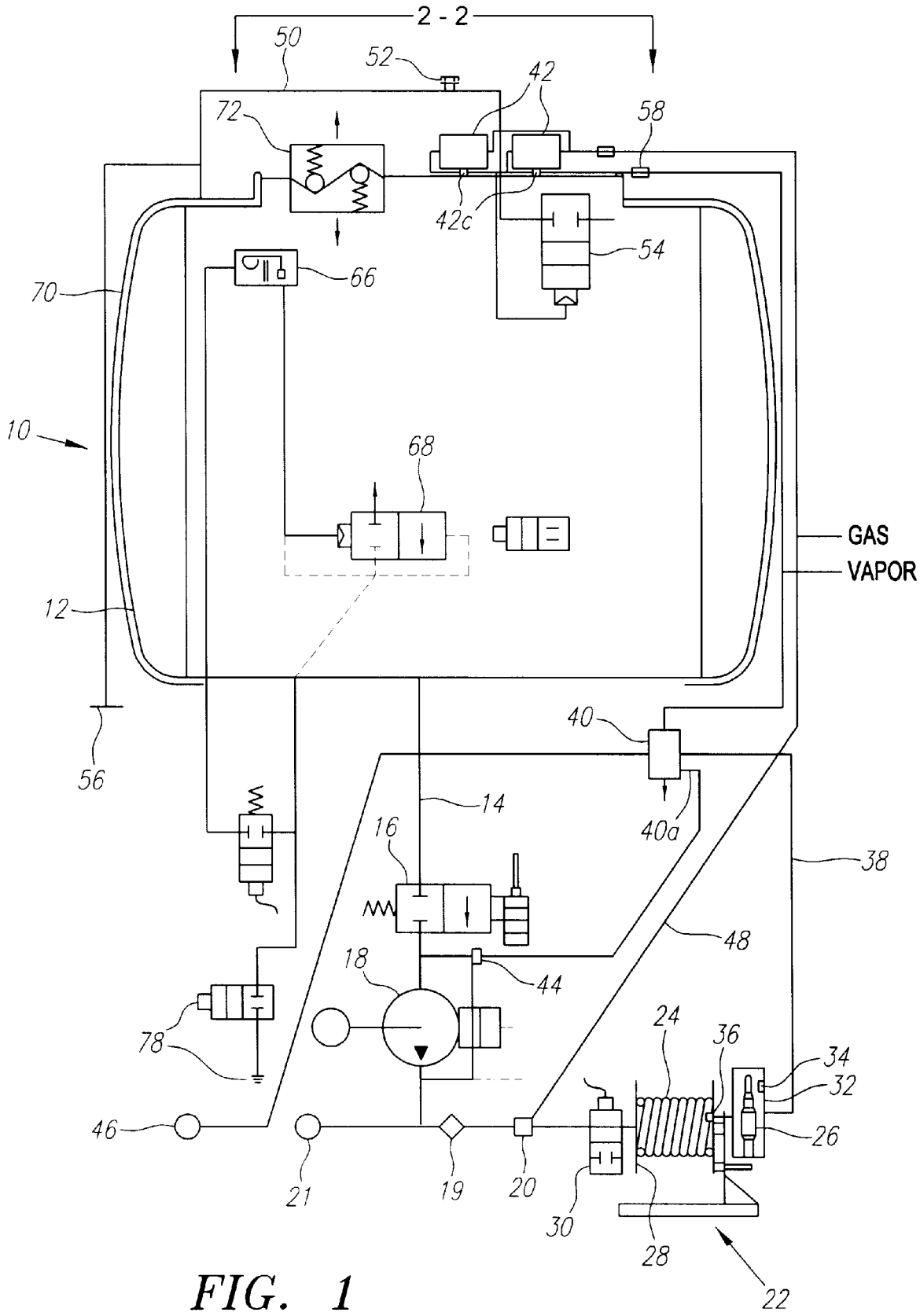
FIG. 1 is a schematic view of a mobile fuel delivery and vapor recovery system, in accordance with the present invention.
Figure 2:
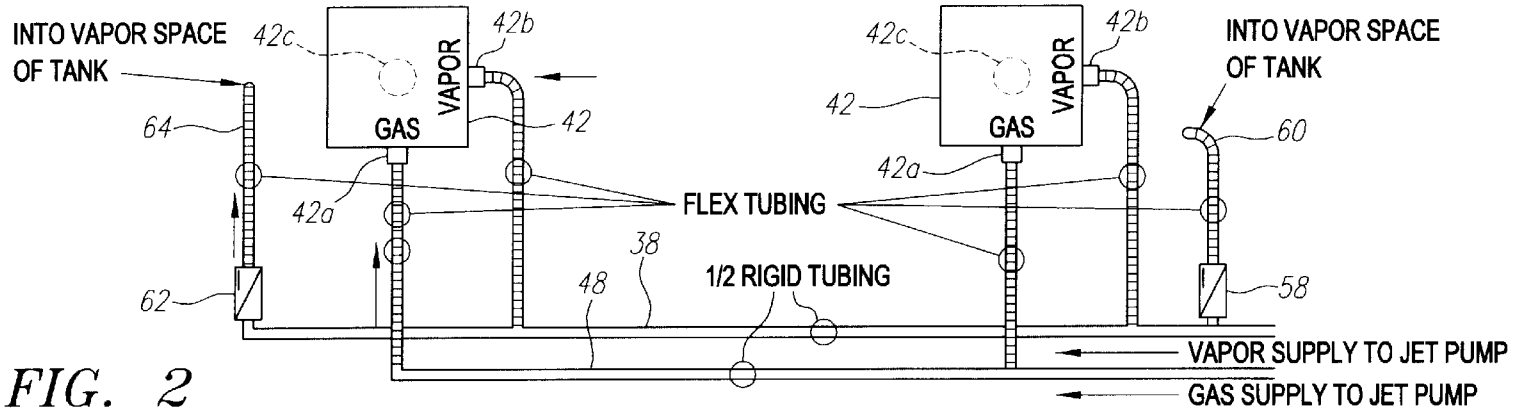
FIG. 2 is a top view of the system of FIG. 1, taken along line 2—2.

Turning now to the drawings, FIGS. 1 and 2 show a preferred embodiment of a mobile fuel delivery and vapor recovery system 10, in accordance with one aspect of the present invention. Generally, the system 10 includes a storage tank 12, a supply line 14 that extends from the storage tank 12 through a shut off valve 16, a supply pump 18, a fuel filter 19 and a diverter valve 20 to one or more fuel dispenser assemblies 22. A pressure gauge 21 may be provided to monitor pressure in the supply line 14 downstream of the supply pump 18. The storage tank 12 is preferably mounted on a vehicle, such as a fuel delivery truck (not shown), and may have a capacity of between about 500 gallons and about 4,000 gallons, preferably between about 700 gallons and about 1,200 gallons, and more preferably about 700 gallons.

The fuel dispenser assembly 22 generally includes a length of coaxial hose 24 terminating in a fuel dispensing nozzle 26. The fuel dispensing nozzle 26 may be one of a variety of conventional nozzles, for example, having an inner spout, which may be inserted into the inlet of a vehicle fuel's tank, and an outer vapor conduit or boot assembly (not shown). Additional information regarding fuel dispensing nozzles appropriate for use with the present invention may be found, for example, in U.S. Pat. Nos. 4,068,687, 5,174,346, 5,178,197, and 5,327,944, the disclosures of which are expressly incorporated herein by reference.

Figure 3:
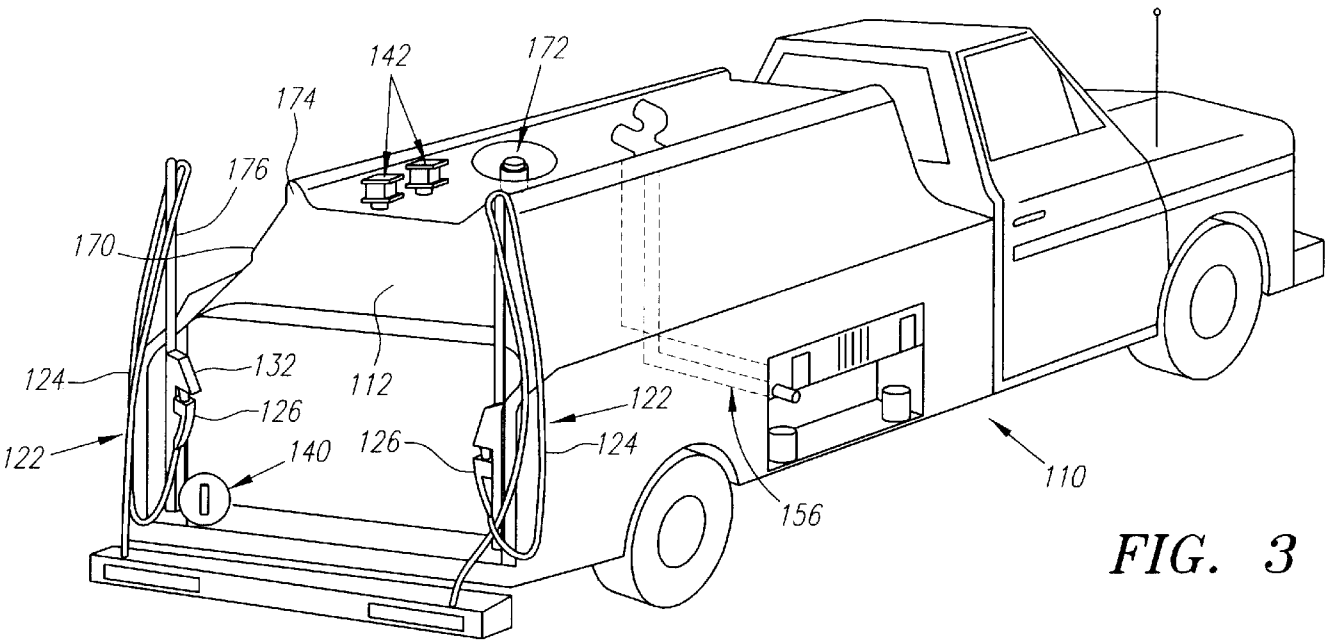
FIG. 3 is a perspective view of a fueling truck including a vapor recovery system in accordance with the present invention.

In a preferred form, the fuel dispensing assembly 22 includes a hose reel 28 for storing the hose 24 when not in use, or alternatively, a hose retractor assembly, such as hose retractor 176 shown in FIG. 3. Preferably, the hose 24 has a length of not more than about 50 feet and more preferably not more than about 22 feet. The fuel dispensing assembly 22 may also include a shut off valve 30 which may be opened when the nozzle 26 is removed from a nozzle hood 32 and/or may be activated by a switch 34. The fuel dispensing assembly 22 also includes a vapor adapter splitter valve 36 connected to the coaxial hose 24 for separating a vapor line 38 from the supply line 14.

The vapor line 38 extends through a vapor pot 40 to a pair of vacuum jet pumps 42 on top of the storage tank 12. Thus, the vapor line 38 communicates from a vapor recovery inlet of the vapor conduit (not shown) on the fuel dispensing nozzle 26 through the coaxial hose 24 and the vapor pot 40 to the vacuum jet pumps 42.

The vapor pot or "drop out" box 40 is configured to remove liquid fuel from the fuel vapor in the vapor line 38, for example, to separate liquid fuel that may be pulled into the vapor recovery inlet of the nozzle 26 and/or that may condense in the vapor line 38. Preferably, the vapor pot 40 is mounted such that it is located at the lowest point in the vapor line 38, such that any liquid in the vapor line 38 will tend to flow into the vapor pot 40 under gravity, i.e., due to the weight of the liquid, thereby facilitating separation of liquid fuel from the vapor.

The vapor pot 40 may also be connected to the supply line 14, for example, to return the separated liquid fuel back into the supply line 14. For example, a liquid fuel outlet 40*a* of the vapor pot 40 may be connected through a siphon check valve 44 into the supply line 14 upstream of the supply pump 18. A vacuum gauge 46 may be connected to the vapor pot 40 to monitor the vacuum pressure therein.

The vacuum jet pumps 42 are generally connected to the vapor pot 40, the diverter valve 20, and to the storage tank 12. For example, as shown in FIG. 2, a fuel diversion line 48 may extend from the diverter valve 20 (not shown in FIG. 2), and the fuel diversion line 48 may be connected to a fuel inlet 42*a* of each vacuum jet pump 42. A vapor inlet 42*b* of each vacuum jet pump 42 may be connected to the vapor line 38, and an outlet 42*c* of each vacuum jet pump 42 may be connected to the storage tank 12, preferably to deliver the recovered vapor into the vapor region of the storage tank 12.

A vacuum relief check valve 58 may be provided in the vapor line 38 to prevent the pressure in the vapor line 38 from exceeding a desired vacuum level. For example, the vacuum relief check valve 58 may be mounted in line with a branch 60 that extends from the vapor line 38 into the storage tank 12, and preferably into the vapor region of the storage tank 12. If the vacuum in the vapor line 38 produced by the vacuum jet pumps 42 exceeds a desired vacuum pressure level, the vacuum relief check valve 58 will open to draw vapor from the vapor region of the storage tank 12 into the vapor line 38 until the vacuum is lowered down to the desired level. In a preferred form, the vacuum relief check valve 58 is set to open if the vacuum pressure in the vapor line 38 exceeds −100 inches of water column, and more preferably −80 inches of water column.

A check valve 62 may be provided in the vapor line 38, preferably in line with a branch 64 that extends into the storage tank 12, and more preferably, into the vapor region of the storage tank 12. The check valve 62 may act to balance the vacuum pressure within the vapor line 38 within a desired range, such as the ranges described further below.

Returning to FIG. 1, the system 10 also generally includes a vapor rail 50 that communicates with the storage tank 12, preferably above the maximum level of liquid fuel in the storage tank 12, i.e., in the vapor region of the storage tank 12, and preferably along the top of the storage tank 12. The vapor rail 50 may include a pressure vacuum vent 52 that may open to release vapor from the storage tank 12 if a maximum safety pressure is exceeded, for example, if the vapor pressure in the storage tank 12 exceeds 8 inches w.g., preferably 3 inches w.g., and more preferably 1 inch w.g.

A vapor recovery valve 54 is also connected to the vapor rail 50 which is mounted within the vapor region of the storage tank 12. The vapor recovery valve 54 is activated during fuel delivery, for example, by a nozzle hanger switch (not shown) on the fuel dispensing assembly 22. When the vapor recovery valve 54 is activated, the vapor recovery system is connected to the pressure vacuum vent 52, i.e., the outlets 42*c* of the vacuum jet pumps 42 are connected through the storage tank 12 and the vapor recovery valve 54 to the vapor rail 50. This allows the release of vapor from the storage tank 12, for example, if the vacuum jet pumps 42 increase the vapor pressure in the storage tank 12 above the maximum safety pressure. When fuel is not being delivered from the nozzle 26, the vapor recovery valve 54 closes to substantially isolate the vapor recovery system from the pressure vacuum vent 52.

The storage tank 12 is at least partially covered with a layer of insulation 70 having a predetermined thermal insulating value. Preferably, all exposed areas of the storage tank 12, the vapor line 38 and the fuel diversion line 48 are covered with at least about a one inch thick layer of polyurethane foam insulation, thereby providing an insulating value of at least about R-14. Futura Coatings, Inc. of St. Louis, Mo. makes a polyurethane foam appropriate for use with the present invention. This is an important feature of the present invention, as the layer of insulation 70 helps maintain a lower temperature, and consequently a lower vapor pressure, inside the storage tank 12. It is important to maintain the vapor pressure inside the storage tank 12 at a low level relative to the vacuum jet pumps 42 in order to produce sufficient vacuum in the vapor line 38 to pull vapor from the nozzle 26 and direct it into the storage tank 12.

In addition, the storage tank 12 may include other conventional features useful for its operation, particularly when the storage tank 12 itself is being filled with fuel prior to use. For example, a Phase I vapor adapter 56 may be connected to the vapor rail 50, preferably being configured for bottom loading, i.e., being mounted below the bottom of the storage tank 12. The Phase I vapor adapter 56 allows the vapor rail 50 to be connected to the vapor recovery system of a stationary fuel source to evacuate vapor from the storage tank 12 as it is being filled with liquid fuel. A pressure-vacuum vent 72 may be mounted directly on the top of the storage tank 12 to release vapor if a maximum safety pressure, e.g., 18 inches w.g., is exceeded when the storage tank 12 is being filled.

A float valve 66 may be provided in the storage tank 12 that is connected to an automatic shut off valve 68 for automatically stopping fuel delivery into the storage tank 12 to prevent overfilling. For example, a nozzle from a stationary fuel source, such as a large capacity fuel storage tank (not shown), may be connected to an inlet 78 of the storage tank 12 to fill the storage tank 12 with fuel. The float valve 66 will float on top of the fuel, and when it engages a stop-plate (not shown) at the top of the storage tank 12, the automatic shut off valve 68 will close to discontinue fuel delivery automatically.

During use of the system 10 to deliver fuel to a vehicle (not shown), the nozzle 26 is removed from the nozzle hood 32, and the supply spout inserted into the vehicle's fuel tank inlet. The shut off valve 30 may be opened automatically upon removal of the nozzle 26 from the nozzle hood 32 and/or may be activated by the switch 34. The vapor recovery valve 54 may consequently be opened such that the vacuum jet pumps 42 communicate with the vapor rail 50.

The supply pump 18 may be activated by removal of the nozzle 26, or may be previously activated, for example, manually. The supply pump 18 generates a fuel pressure within the supply line 14 to deliver fuel to the fuel dispensing assembly 22, and consequently generates a fuel pressure in the fuel diversion line 48. Preferably, the pressure ranges from between about 20 psi and about 40 psi when the nozzle 26 is open, and more preferably between about 22 psi and about 26 psi.

The resulting fuel pressure drives the vacuum jet pumps 42 to create a vacuum in the vapor line 38, preferably between about −20 inches w.g. and about −70 inches w.g. when the nozzle 26 is open, more preferably between about −20 inches w.g. and about −40 inches w.g., and even more preferably between about −27 inches w.g. and about −34 inches w.g. When the nozzle 26 is closed, the pressure in the fuel diversion line 48 preferably creates a vacuum in the vapor line 38 between about −20 inches w.g. and about −80 inches w.g., more preferably between about −40 inches w.g. and about −72 inches w.g., and even more preferably between about −65 inches w.g. and about −72 inches w.g.

The vacuum created by the vacuum jet pumps 42 pulls vapor emitted from the supply spout into the vapor recovery inlet of the nozzle 26, preferably recovering at least about 94.5 percent of the vapor, and more preferably recovering at least about 98 percent of the vapor. These high levels of vapor recovery efficiency are achieved primarily due to the unique combination of features comprising the system 10.

For example, it is important that the system 10 facilitates control of the vapor pressure within the storage tank 12 and of vacuum pressure within the vapor line 38. In order for the system 10 to effectively recover vapor from the nozzle 26, the vacuum pressures created by the vacuum jet pumps 42 must be substantially higher than the vapor pressure within the storage tank 12. At the same time, the vapor pressure within the storage tank 12 must be maintained at relatively low, substantially safe levels. The insulation on the storage tank 12, the fuel diversion line 48 and the vapor line 38 substantially minimizes heating of the interior of the storage tank 12 which may increase vapor pressure therein, thereby reducing the overall vacuum requirements to recover vapor efficiently.

The system 10 also allows use and effective control of fuel pressure from the supply pump 18 to drive the vacuum jet pumps 42 without substantially interfering with the supply line 14, thereby facilitating control of the vacuum produced in the vapor line 38. A relatively small amount of fuel may be diverted from the supply line 14 to the vacuum jet pumps 42 to create sufficient vacuum that efficiently draws vapor from the nozzle 26. Thus, by effectively minimizing the vapor pressure encountered in the storage tank 12, the vacuum jet pumps 42 may efficiently draw vapor from the nozzle 24 through the vapor line 38 and into the storage tank 12. The efficiency of the system 10 may be such that certain components used in conventional mobile fuelers, such as the vapor rail 50 and/or the pressure vacuum vent 52, are unnecessary and may be eliminated.

In accordance with another aspect of the present invention, a kit is provided that may be used for retrofitting an existing mobile fueler, which may not already be equipped with a vapor recovery system. At a minimum, the kit may include one or more vacuum jet pumps, a diverter valve, a vapor pot, and one or more fuel dispensing assemblies. Preferably, the kit also includes valves for controlling pressure within the supply and vapor lines, and insulation for covering desired components to reduce vapor pressure in the system.

For example, as shown in FIG. 3, the kit may be used to retrofit an existing fuel truck 110, which may include an uninsulated storage tank 112 and a supply line. The supply line generally includes a supply pump, a fuel filter, and one or more single wall hoses and nozzles (all not shown). The fuel truck 110 may also include a vapor rail (not shown), preferably below turn-over rails 174 on the storage tank 112, to which a Phase I vapor adapter 156, and a pressure-vacuum vent 172 may be connected.

The single wall hoses and nozzles may be removed, and optionally the vapor rail and/or pressure vacuum vent may be removed. The diverter valve is mounted in the supply line, preferably after the supply pump and fuel filter, but before any metering equipment. A fuel dispensing assembly 122 is attached to the fuel truck 110, or alternatively a pair of fuel dispensing assemblies 122 may be mounted, as shown. Each fuel dispensing assembly 122 preferably includes a coaxial hose 124, a hose retractor assembly 176, a coaxial fuel dispensing nozzle 126, and a nozzle hood 132. Alternatively, a reel assembly (not shown) may be provided instead of the hose retractor assembly 176. The fuel dispensing assembly 122 also preferably includes a vapor adapter splitter valve (not shown) for converting the coaxial hose to a pair of single wall connectors, i.e., a supply connector and a vapor connector. The supply line is extended from a main supply outlet of the diverter valve to the supply connector of the vapor adapter splitter valve.

A vapor pot 140 is mounted at a low point in the system, preferably below the bottom of the storage tank 112, and a vapor line is connected from the vapor connector of the vapor adapter splitter valve to an inlet of the vapor pot 140. A siphon check valve may be connected between a liquid outlet of the vapor pot 140 and the supply line, preferably before the supply pump.

One or more, and preferably a pair of, vacuum jet pumps 142 are mounted on the truck 110, preferably on the storage tank 112 between the roll-over rails 174. A vapor outlet of the vapor pot 140 is connected to a vapor inlet of each of the vacuum jet pumps 142. The outlet of each of the vacuum jet pumps 142 is connected to the storage tank 112, preferably dropping vertically downward from the vacuum jet pumps 142 into the vapor region of the storage tank 112. A vacuum relief check valve (not shown) may be connected in parallel with the vacuum jet pumps 142 between the vapor line and the storage tank 112, to prevent excessive vacuum pressure in the vapor line. Similarly, a fuel pressure check valve (not shown) may be connected in parallel with the vacuum jet pumps 142 between the fuel diversion line and the storage tank 112.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A fuel delivery and vapor recovery system for a mobile fueler, comprising:

a mobile storage tank having a liquid region and a vapor region therein, the storage tank being at least partially covered with a layer of insulation providing a predetermined thermal insulating value;

a supply pump connected to the storage tank for delivering fuel from the liquid region, the supply pump configured for generating a fuel pressure between 26 and about 40 psi in a supply line leading from the storage tank;

a fuel dispensing assembly connected to the supply line, and including a supply outlet for delivering fuel from the storage tank to a vehicle being fueled, and a vapor recovery inlet proximate the supply outlet;

a diverter valve for diverting a portion of the fuel in the supply line;

a vacuum jet pump connected by a vapor line to the vapor recovery inlet and connected to the diverter valve, the vacuum jet pump being driven by the fuel diverted from the supply line to create a predetermined vacuum pressure in the vapor line of between −34 inches w.g. and about −70 inches w.g. when the supply outlet is open, the vacuum jet pump being connected to the storage tank to direct vapor in the vapor line into the vapor region of the storage tank;

a vapor pot in the vapor line for separating liquid fuel from vapor in the vapor line; and a check valve connected between the vapor line and the vapor region of the storage tank for maintaining pressure in the vapor line within a predetermined pressure range.

2. The system of claim 1, wherein the vapor pot is connected to the supply line for returning separated liquid fuel back to the supply line.

3. The system of claim 2, further comprising a siphon check valve connected between the vapor pot and the supply line.

4. The system of claim 1, wherein the vapor pot is mounted at a low point of the system.

5. The system of claim 1, wherein the predetermined insulating value of the layer of insulation is at least about R-14.

6. The system of claim 1, where in the layer of insulation comprises polyurethane foam.

7. The system of claim 1, wherein the storage tank has a storage capacity between about 500 gallons and about 4,000 gallons.

8. The system of claim 1, wherein the vapor line recovers at least about 95% of the fuel vapor from the fuel dispensing assembly.

9. The system of claim 1, wherein the vacuum pump is mounted at a level higher than the liquid region of the storage tank.

10. The system of claim 1, wherein the fuel dispensing assembly comprises a coaxial hose and nozzle.

11. The system of claim 10, wherein the fuel dispensing assembly further comprises a hose reel for storing the coaxial hose.

12. The system of claim 10, wherein the fuel dispensing assembly further comprises a vapor adapter splitter valve.

13. The system of claim 10, wherein the coaxial hose has a length between 22 feet and about 50 feet.

14. The system of claim 1, wherein the fuel dispensing assembly further comprises a vapor adapter splitter valve for separating the vapor line from the supply line.

15. The system of claim 1, further comprising a pair of vacuum jet pumps connected to the vapor line, the fuel diversion line, and the storage tank.

16. A kit for retrofitting a mobile fueler having a storage tank and a supply line, including a supply pump, for delivering fuel from the storage tank to a vehicle being fueled, the kit comprising:

a layer of insulation for substantially covering the storage tank;

a diverter valve connectable in the supply line for diverting a portion of the fuel being delivered from the storage tank;

a fuel dispensing assembly connectable to the supply line, including a supply outlet for delivering fuel to the vehicle being fueled, and a vapor recovery inlet proximate the supply outlet;

a vapor pot connectable by a vapor line to the vapor recovery inlet for separating liquid fuel from vapor in the vapor line;

a vacuum jet pump having a vapor inlet connectable to the vapor line, a vapor outlet connectable to the storage tag and a fuel inlet connectable by a fuel diversion line to the diverter valve, the vacuum jet pump having a fuel path through which fuel diverted from the supply pump is directed to create a vacuum pressure in the vapor line of between −34 inches w.g, and about −70 inches w.g. when the supply outlet is open; and a check valve connectable in parallel with the vacuum jet pump for balancing vacuum pressure in the vapor line within a predetermined range.

17. The kit of claim wherein the fuel dispensing assembly comprises a coaxial hose and nozzle.

18. The kit of claim 17, wherein the fuel dispensing assembly further comprises a hose reel for storing the coaxial hose.

19. The kit of claim 16, wherein the fuel dispensing assembly comprises a vapor adapter splitter valve.

20. The kit of claim 16, wherein the layer of insulation comprises foam insulation having a thermal insulating value of R-14.

21. The kit of claim 16, further comprising a vacuum relief check valve connectable in parallel with the vacuum jet pump.

22. The kit of claim 16, further comprising a siphon check valve connectable between the vapor pot and the supply pump.

23. A method for recovering fuel vapor during delivery of fuel from a mobile fuel delivery system to a vehicle, the method comprising the steps of:

providing a mobile storage tank and a supply line communicating with the storage tank;

providing a fuel dispensing assembly connected to the supply line, the fuel dispensing assembly comprising a supply outlet and a vapor recovery inlet proximate the supply outlet;

directing fuel from the storage tank through the supply line at a pressure of between 26 and about 40 psi to the supply outlet;

diverting a portion of the fuel in the supply line to generate a predetermined vacuum pressure of between −34 inches w.g. and about −80 inches w.g. at the vapor recover inlet to substantially recover at least about 95 percent of the fuel vapor emitted from the supply outlet;

separating liquid fuel from fuel vapor recovered from the vapor recovery inlet;

maintaining the vacuum pressure at the vapor recover inlet within a predetermined range and directing the recovered fuel vapor into the storage tank.

24. The method of claim 23, wherein the vacuum is generated by directing the diverted fuel through a vacuum jet pump to create the predetermined vacuum pressure in a vapor line communicating with the vapor recovery inlet.

25. The method of claim 24, comprising the additional step of controllably introducing vapor from the storage tank into the vapor line to maintain the predetermined vacuum pressure.

26. The method of claim 25, wherein the predetermined vacuum pressure is maintained within a range between −34 inches and about −80 inches of water column.

27. The method of claim 24, wherein the fuel vapor is directed by the predetermined vapor pressure through the vapor line and vacuum jet pump into the storage tank.

28. The method of claim 24, wherein the step of separating liquid fuel comprises separating liquid fuel in the vapor line from the recovered fuel vapor before directing the recovered fuel vapor into the storage tank.

29. The method of claim 28, comprising the additional step of returning the separated liquid fuel in the vapor line back into the supply line.

30. The method of claim 23, wherein the storage tank is at least partially covered with a predetermined layer of insulation.

31. The method of claim 30, wherein the predetermined layer of insulation has a thermal insulating value of at least about R-14.

32. The method of claim 23, wherein at least about 98 percent of the fuel vapor emitted from the supply outlet is recovered by the vapor line.

* * * * *